United States Patent [19]

Oliver et al.

[11] Patent Number: 4,648,257

[45] Date of Patent: Mar. 10, 1987

[54] ROLLING MILL ECCENTRICITY COMPENSATION USING ACTUAL MEASUREMENT OF EXIT SHEET THICKNESS

[75] Inventors: Dickon T. Oliver, Pittsburgh; D. Fred Stewart, Export, both of Pa.

[73] Assignee: Aluminum Company of America, Pittsburgh, Pa.

[21] Appl. No.: 771,505

[22] Filed: Aug. 30, 1985

[51] Int. Cl.[4] ..... B21B 37/02

[52] U.S. Cl. ..... 72/16; 72/8

[58] Field of Search ..... 72/16, 20, 8; 364/472

[56] References Cited

U.S. PATENT DOCUMENTS 3,928,994 12/1975 Ichiryu et al. ..... 72/16 X 4,220,025 9/1980 Baba et al. ..... 72/16 X 4,545,228 10/1985 Yamaguti et al. ..... 72/16

*Primary Examiner*—Lowell A. Larson

*Assistant Examiner*—Steve Katz

*Attorney, Agent, or Firm*—Elroy Strickland

[57] ABSTRACT

A method of controlling a rolling mill in which eccentricity of one or more of the rolls of the mill ordinarily cause cyclic change in the thickness of the material exiting the mill. The method includes the steps of locating a device for measuring thickness downstream from the mill, and using the device to measure directly cyclic change in the thickness of the mill due to roll eccentricity. Samples of the cyclic change in thickness are provided during a time period defined by a revolution of at least one of the rolls. The samples are processed by characterizing them as frequency, magnitude and phase angle components of the change in thickness. These components are then directed to an update algorithm to provide a current estimate of the change in thickness. The delay between the occurrence of the change in thickness in the mill and the occurrence of the measurement of the change by the thickness measuring device is calculated and translated into a phase angle component. The current estimate of the phase angle is modified by the angle due to the delay in actual measurement of thickness such that the results of the step of measuring thickness are made coincident with the occurrence of the thickness change in the mill. The current estimate of thickness change is now processed in a manner that returns the estimate to time-based values; such values are then used to correct roll eccentricity by controlling the working gap of the mill in a manner that offsets the effects of roll eccentricity.

2 Claims, 1 Drawing Figure

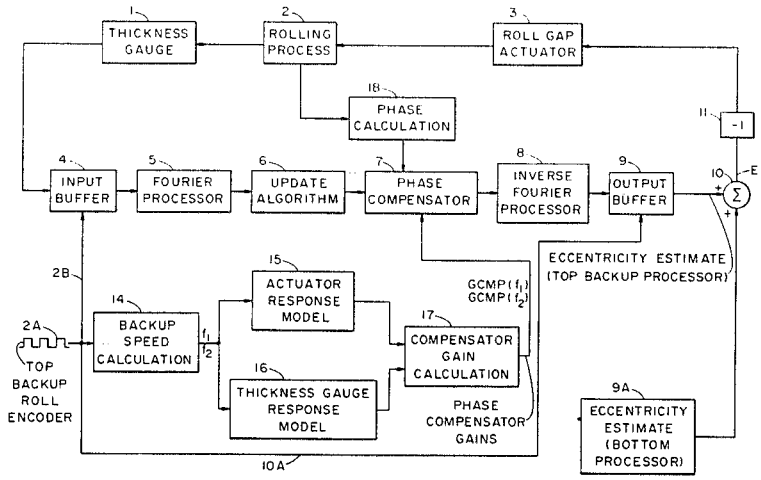

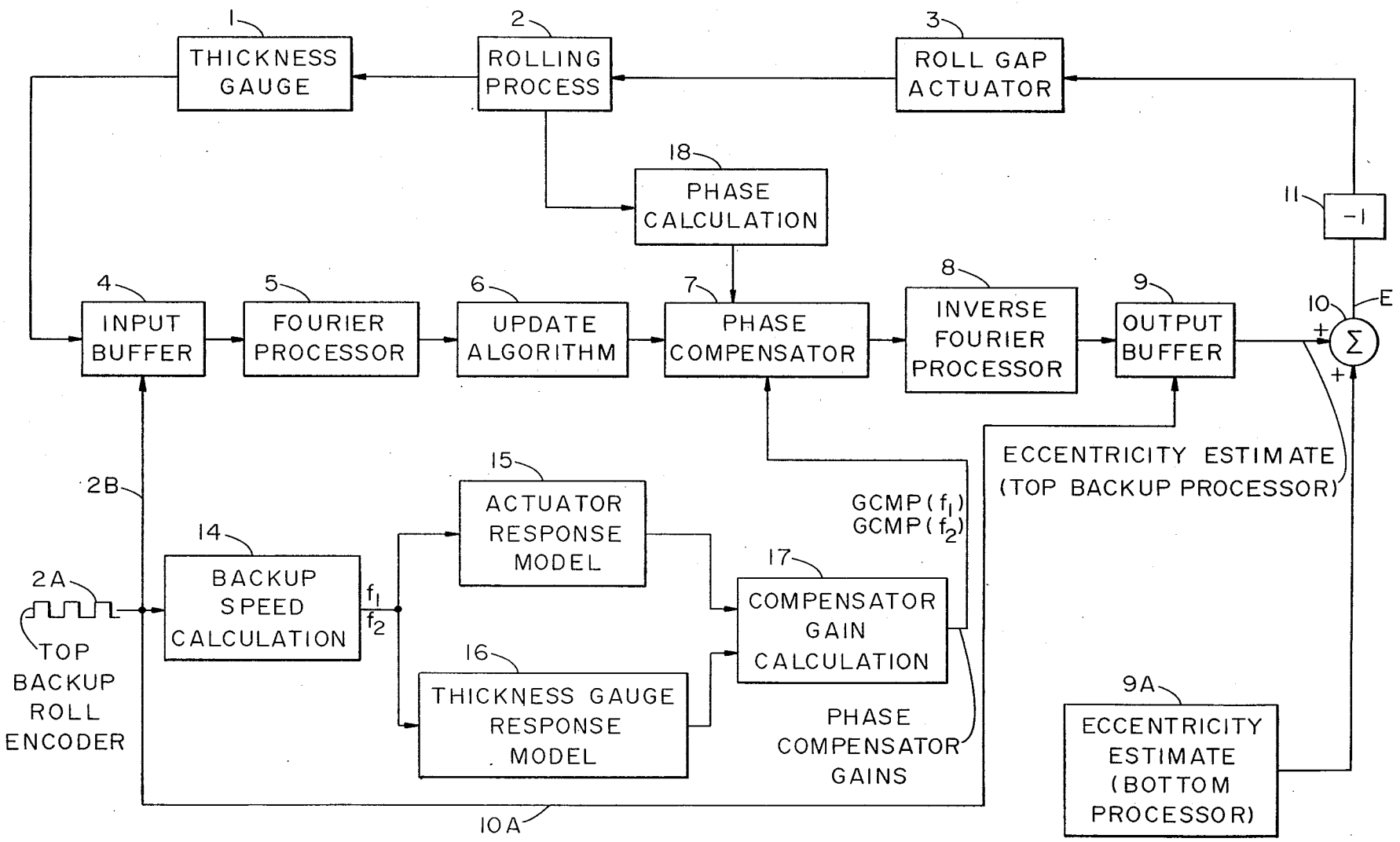
THICKNESS GAUGE
1
ROLLING PROCESS
2
ROLL GAP ACTUATOR
3
INPUT BUFFER
4
FOURIER PROCESSOR
5
UPDATE ALGORITHM
6
PHASE COMPENSATOR
7
INVERSE FOURIER PROCESSOR
8
OUTPUT BUFFER
9
ECCENTRICITY ESTIMATE (BOTTOM PROCESSOR)
9A
ECCENTRICITY ESTIMATE (TOP BACKUP PROCESSOR)
10
10A
E
Σ
+
+
-1
11
PHASE CALCULATION
18
BACKUP SPEED CALCULATION
14
ACTUATOR RESPONSE MODEL
15
THICKNESS GAUGE RESPONSE MODEL
16
COMPENSATOR GAIN CALCULATION
17
PHASE COMPENSATOR GAINS
GCMP(f1)
GCMP(f2)
f1
f2
2A
2B
TOP BACKUP ROLL ENCODER

ROLLING MILL ECCENTRICITY COMPENSATION USING ACTUAL MEASUREMENT OF EXIT SHEET THICKNESS

BACKGROUND OF THE INVENTION

The invention relates generally to the control of rolling mills in a manner that offsets the cyclic effects of roll assemblies, hereinafter called eccentricity, on the thickness of material being rolled.

A system for controlling the effects of roll eccentricity in a rolling mill is disclosed in U.S. Pat. No. 4,222,254 to King et al, the disclosure of this patent being incorporated herein by reference. An improvement in the King et al system is disclosed in pending U.S. Ser. No. 591,277, filed Mar. 19, 1984 in the name of Mark Puda, now U.S. Pat. No. 4,531,392. The disclosure of the Puda patent is also incorporated herein by reference.

Both the King et al and Puda disclosures employ a process by which the eccentricity of one or more roll assemblies of a mill is inferred by making mathematical estimates of eccentricity. Such estimates of eccentricity are made because the actual eccentricity of the rolls is not readily observable.

The estimates made in the King et al patent and the Puda patent are based on measurements of changes in the force at which the rolls of the mill engage the material being rolled in the mill, measuring changes in the stretch or compression of the mill housing during the rolling process and measuring changes in the position of the actuator mechanisms (mechanical screws or hydraulic cylinders) that control the working space and rolling force of the mill. These measurements are then used in a gaugemeter equation to estimate changes in the thickness of the material exiting the mill due to roll eccentricity.

The estimating process is continuous until the cyclic component in exit thickness due to roll eccentricity is reduced to a minimum or zero amount and the estimate of eccentricity reaches a steady state value representing the true eccentricity of the rolls.

As discussed in the Puda patent, the load cells and actuator mechanisms of the mill do not respond as fast as the occurrence of the eccentricity disturbance at high travel speeds of the material through the mill. Hence, the resulting control signals of the system can contain a delay in their response to eccentricity. The Puda disclosure cares for this by a process of developing phase compensated gains that are used to modify the amplitude and phase of the estimate of eccentricity calculated by the means disclosed in the King et al patent. The control signals directed to the actuator mechanisms of the mill are thereby phase corrected to care for the delay in the response of the load cells and actuator mechanism.

BRIEF SUMMARY OF THE INVENTION

Instead of inferring estimates of roll eccentricity from measurements of rolling force and the positions of actuator mechanisms in a process to control the effects of eccentricity, the present invention uses a device for directly measuring the thickness of the material exiting the mill, the device providing direct measurements of cyclic changes in the thickness of the material due to roll eccentricity. These measurements are then employed to offset the effects of eccentricity on the thickness of the material being rolled.

BRIEF DESCRIPTION OF THE DRAWING

The invention, along with its objectives and advantages, will be best understood from consideration of the following detailed description and the accompanying drawing in which the sole FIGURE thereof is a flow diagram showing certain control means of the above King et al and Puda patents in combination with the thickness measurement system of the present invention.

DETAILED DESCRIPTION OF THE PREFERRED EMBODIMENT

Referring now to the drawing, the FIGURE thereof shows diagrammatically Fourier processors and an update algorithm of the King et al patent along with the phase compensation scheme of the Puda patent to provide estimates of roll eccentricity. However, instead of using the load cell, housing stretch and actuator position measurements employed in these disclosures, the present invention locates a thickness measuring device 1, such as an X-ray gauge, downstream from a stand of a rolling mill, process 2, to provide data for estimating eccentricity. An X-ray gauge is only one of many devices available for measuring thickness so that the invention is not limited to the use of an X-ray gauge.

In the drawing, rectangles are used to indicate the processes of the above King et al patent and Puda patent, as well as the processes of the subject invention. In addition, two such arrangements are required, one for each roll assembly of a rolling mill. The arrangements are identical, however, so that only one is shown in detail in the drawing, the other is exemplified by a single box 9A.

More particularly, the drawing shows the output of thickness gauge 1 directed to an input buffer 4 of a digital computer; the computer is not otherwise depicted in the FIGURE of the drawing except by the boxes shown in addition to that of 4; the processes represented by the boxes are described in detail hereinafter.

The output of thickness gauge 1 is an analogue signal and is a measurement of the eccentricity of a roll assembly of the rolling mill, process 2, as the eccentricity is reflected in the changing thickness of the material exiting the mill. It is also a measurement of material thickness, as developed in a manner presently to be explained. It is this signal that is fed to input buffer 4.

Each roll assembly is fitted with a pulse encoder, as shown schematically in the King et al patent, that generates a series of pulses, each pulse corresponding to a position increment of the revolution of the roll or rolls of the assembly. A series of pulses 2A is shown in the drawing representing the output of such an encoder associated with an upper roll assembly. Such pulses are directed to input buffer 4 (via line 2B in the drawing), and, upon receiving each pulse, the buffer samples the measurement of thickness change being directed to the buffer from the thickness gauge. The buffer also stores the measurement. This process continues for every pulse received by 4 until one complete revolution of the roll of the assembly has occurred. At this time, the data (i.e. estimates) stored in 4, which now represents a complete cycle of changing thicknesses due (partly) to roll eccentricity, is transferred to a Fourier processor 5 of the computer. The processor transforms the data into a set of complex numbers that represent separate and distinct frequency, amplitude and phase angle components of the change in thickness during each revolution of the roll. The frequency component includes both fundamental and harmonics thereof.

The components provided by the Fourier processor of 5 are now directed to an algorithm 6 that continuously updates the components to provide current estimates of changes in thickness. The details of this algorithm are described in the King et al patent. By means of an inverse Fourier transform 8, the components provided by Fourier transform 5 and updated by algorithm 6 are changed back to a revolution based signal and applied to a mill roll gap actuator 3.

The revolution based signal of 8, however, is first incrementally stored in an output buffer 9 of the computer and sequentially directed to a summing junction 10 on the occurrence of each pulse 2A received from the roll encoder. Line 10A in the FIGURE indicates such directing of the pulses to buffer 9. The output of buffer 9 is a series of values that correspond to the eccentricity estimates of the upper roll assembly of the mill. A similar set of values is provided for the lower roll assembly, as indicated by box 9A. The processes of 9A are the same as those described above in connection with the Fourier transform and update algorithm such that they need not be depicted in detail in the drawing.

The output of 9A is also directed to summing junction 10. Junction 10 adds the values received from each output buffer to provide an estimate E that is the combined eccentricity of both roll assemblies. This estimate is then employed to regulate the position of the mill roll gap actuator 3 in an equal but opposite direction (via invertion of E at box 11) to the actual eccentricity. This results in cancellation of the effects of eccentricity on the material exiting the mill.

As explained in the Puda patent, however, mill actuators and load measuring cells cannot respond as rapidly as the occurrence of thickness changes due to roll eccentricity; a phase lag is thereby introduced into the system for controlling the mill in a manner to offset roll eccentricity. Puda cares for this by phase compensation before the output of the update algorithm of 6 is passed to the inverse Fourier processor 8. Box 7 represents this compensation in the FIGURE. The compensation is effected by first calculating the rotational speed of the upper roll at 14, using the frequency of the pulses 2A issuing from the pulse encoder, or by using a separate speed measurement, and providing models of the dynamic responses of the roll gap actuators and thickness measuring instrumentation. (This same procedure is performed for the other (lower) roll of the mill.) As, explained further in the Puda patent, these models are stored equations representing dynamic responses of the actuators and load cells.

The calculation made at 14 provides a value that is the precise error introduced into the system at each of the eccentricity frequencies, fundamental and harmonic, by the actuators and load cells. In the Puda patent, this data is available at 15 and 16 in the drawing and provides a calculation of phase compensator gain at 17; this gain is used to correct at 7 the phase of the value input to the inverse Fourier processor 8.

In the present invention, the gain provided by 17 is still used, as there is phase lags from the thickness gauge and gap actuators, except that the response model of the load cell of Puda is replaced by that of a model 16 representing the dynamic response of thickness gauge 1, as the thickness gauge exhibits an inherent lag in its response to changes in material thickness exiting mill 2. The mathematical processes for determining this lag and error is the same as that for determining the lag of the load cells of the mill.

With the compensation effected at 7, the estimate of eccentricity at 10, as provided by the output of thickness gauge 1, is in phase with the eccentricity of the rolls such that the eccentricity can be correctly offset by positioning the actuators 3 in equal but opposite direction to the estimate of eccentricity.

The location of thickness gauge 1, however is physically spaced from the location of the mill stand 2 such that occurrence of the change in material thickness in the stand and the occurrence of the detection of the change is not the same. For this reason, a value is calculated at 18 to represent this delay so that the thickness information directed from the output buffer 9 will not be out of sync with occurrence of the actual thickness change in the mill.

The delay value, however, must be translated into a phase angle value so that it can be combined with the phase angle component provided by the processes of the Fourier transform function of 5. This is accomplished in the process performed in phase compensator 7, receiving the value calculated at 18. The output of 7 thus contains information corrected for both the inherent delay in transducer responses and the delay in gauge 1 responses due to the distance existing between the mill stand and the gauge. In this manner, the eccentricity information from the output buffers and from summing junction 10 is synchronously correct with respect to the actual occurrence of the changes in thickness occurring in the mill. And, in this manner, the positions of the roll gap actuators 3 are changed to offset the effects of roll eccentricity; the material exiting the mill is thereby free of undulating, cyclic changes in thickness due to eccentricity.

While the invention has been described in terms of preferred embodiments, the claims appended hereto are intended to encompass all embodiments which fall within the spirit of the invention.

What is claimed is:

1. A method of controlling a rolling mill in which eccentricity of one or more of the rolls in a stand of the mill ordinarily cause cyclic change in the thickness of material exiting the mill, the method comprising the steps of:

directing material through the mill, locating a device for measuring the thickness of the material exiting the mill downstream from the mill stand, using said device to measure directly cyclic change in the thickness of the material resulting from roll eccentricity, providing samples of said cyclic change in thickness during a time period defined by a revolution of at least one of the rolls, processing the samples of said change by characterizing them as frequency, magnitude and phase angle components of the change using a Fourier transform function, using said components in an update algorithm to provide a current estimate of the change in thickness, calculating the delay between the occurrence of the change in thickness in the mill and the occurrence of the measurement of the change, the delay being caused by the distance existing between the mill stand and the location of measurement;

translating the delay into a phase angle component;

modifying the current estimate of the eccentricity phase angle by the angle due to the delay such that the results of the thickness measuring step are made to coincide with the occurrence of the thickness change in the mill, processing the current estimate of thickness change in a manner that returns the estimate to time based values using an inverse Fourier transform function, and using said time base values to correct for roll eccentricity by controlling the working gap of the mill in a manner that offsets the effects of roll eccentricity in synchronism with the occurrence of eccentricity.

2. The method of claim 1 wherein the frequency component of the samples of cyclic changes in thickness includes a fundamental frequency and harmonic frequencies thereof.

* * * * *